United States Patent [19]

Bosch

[11] 4,409,811

[45] Oct. 18, 1983

[54] PROCESS AND A SPINNING LATHE FOR PRODUCING WHEEL RIMS

[75] Inventor: Walter Bosch, Ostfildern, Fed. Rep. of Germany

[73] Assignee: Bohner & Koehle GmbH & Co., Esslingen, Fed. Rep. of Germany

[21] Appl. No.: 276,865

[22] Filed: Jun. 24, 1981

[30] Foreign Application Priority Data

Jun. 30, 1980 [DE] Fed. Rep. of Germany ..... 3024744

[51] Int. Cl.[3] ..... B21H 1/10

[52] U.S. Cl. ..... 72/82; 72/125; 29/159.1

[58] Field of Search ..... 72/82, 84, 91, 125; 29/159.1

[56] References Cited

U.S. PATENT DOCUMENTS

| | | | |
|---|---|---|---|
| 1,370,557 | 3/1921 | Pierce | 72/125 |
| 3,255,518 | 6/1966 | Golata | 72/84 |
| 3,738,139 | 6/1973 | Proops et al. | 72/84 |
| 4,064,726 | 12/1977 | Hinze | 72/82 |
| 4,143,533 | 3/1979 | Bosch | 29/159.1 |

FOREIGN PATENT DOCUMENTS

| | | | |
|---|---|---|---|
| 2053005 | 5/1972 | Fed. Rep. of Germany | 72/82 |

*Primary Examiner*—Lowell A. Larson

*Attorney, Agent, or Firm*—Flynn, Thiel, Boutell & Tanis

[57] ABSTRACT

The process of the invention is designed for producing wheel rims having a snap-in groove on one side of the rim, in which a blank having an inner coned part for forming the eventual wall of the snap-in groove in the completed wheel rim and with an outer cylindrical part joined up with the smaller end of the coned part is formed on a spinning lathe using spinning rollers by outwardly bending and flaring the outer cylindrical part. In the process the blank is slipped onto a mandril which has a coned outer face to be in line with the coned form of the blank, while the outer cylindrical part of the blank stationarily extends out beyond the end of the mandril. Then the blank is gripped with an outer chuck and then at least one spinning roller, conforming to the desired form to be produced, is moved axially up against the end of the blank overlapping the mandril so that, while causing axial upsetting of the blank, the outer cylindrical part is bent outwards against the outer chuck for forming the outer wall of the snap-in groove.

19 Claims, 6 Drawing Figures

PROCESS AND A SPINNING LATHE FOR PRODUCING WHEEL RIMS

FIELD OF THE INVENTION

The present invention relates to a process for producing wheel rims, more specially for trucks and having a snap-in groove on one side of the rim, in which a blank or preform having an inner coned part for forming the eventual wall of the snap-in groove in the completed wheel rim and with an outer cylindrical part joined up with the smaller end of the coned part, is formed on a spinning lathe using spinning rollers by outwardly bending the outer cylindrical part. The invention furthermore relates to a spinning lathe and to the tool system of such a lathe more specially for use in the process of the present invention.

BACKGROUND OF THE INVENTION

The snap-in groove of a wheel rim is a part acted upon by very heavy forces so that, on bending out the outer cylindrical part of the blank to make the outer wall of the snap-in groove, special care is necessary to see that there is the least possible loss in strength of the material. This danger of a loss in strength is likely on using spinning rollers because a spinning operation is frequently responsible for material flow. Furthermore, it has been normal in the industry for a groove to be produced by using two spinning rollers, one acting on the outside of the work and the other on its inside, the shortcoming here being that the outer spinning roller, against which the work is forced by the inner spinning roller, gives way elastically somewhat so that tight size limits may not be kept to and, in fact, the work has to be trued up in a later, further working step.

SUMMARY OF THE INVENTION

For this reason, one purpose of the present invention is that of designing a process and a spinning lathe and tools therefor with which a snap-in groove may be produced within tight size limits so that later truing up is not necessary. Furthermore, the wheel rim is to be so processed that, on outwardly bending the material for forming the outer wall of the snap-in groove, the wall thickness is not decreased.

For effecting these and other purposes in the present invention the blank or preform is slipped onto a mandril, which, itself, is coned to be in line with a coned part of the blank, of a spinning lath, the outer cylindrical end part of the blank extending out beyond the end of the mandril, then the blank or preform is gripped with the help of an outer chuck and then at least one spinning roller, having the desired form to be produced, is moved axially against an end of the blank so that, while causing axial upsetting of the blank, the outer cylindrical part is bent outwards against the outer chuck for forming the outer wall of the snap-in groove.

It will be seen that in the invention spinning takes place against an outer chuck forming a part of the spinning form or mold, the outer chuck not giving way when the forming operation is taking place so that the snap-in groove may be produced within tight size limits or a tight tolerance and no later truing up operation will be necessary. Furthermore, the spinning roller or rollers is moved axially against the work so that, for flaring out and outwardly bending the outer cylindrical part of the blank, there is an upsetting of the material stopping the material becoming thinner on being bent outwards so that, furthermore, the wall thickness at the floor of the groove, which is a specially important part of the structure, may be produced with the desired, true size.

More specially the first spinning roller is used for forming the outer cylindrical part outward, that is to say bending it outwards so as to provide an average angle of for example 45° to 75°, whereafter a second spinning roller is used for completing the outer wall of the snap-in groove, the first spinning roller being responsible for axially upsetting the outer cylindrical part and flaring the same and the second spinning roller is used firstly only for bending the outer cylindrical part, bent outwards into the inbetween position, and then upsetting it till the desired wall thickness of the snap-in groove wall is produced, at least the second spinning roller being moved up axially against the work with the axis of turning at an angle to the axis of turning of the work. The first spinning roller is, for this reason, responsible for flaring (and axial upsetting) of the blank or preform till the blank is in an inbetween position, while the second spinning roller firstly has the effect of outwardly bending the outer wall of the snap-in groove further whereafter the spinning roller is moved further up against the work for upsetting the material. The axis of turning of the spinning roller, which is at an angle to the axial direction of motion towards the work, is responsible for the useful effect that between the work and the spinning roller there is no friction but only a rolling effect.

The spinning lathe of the present invention and the tool set therefor, more specially for undertaking the process of the invention, is characterized in that the mandril supporting the work to be processed and joined fixedly at its inner end (opposite to its free end) with the headstock spindle has a spaced concentric cylindrical sleeve placed around it, which, as well, has an inner end fixed to the headstock spindle while a front, opposite end of the sleeve has chuck jaws (which may be radially moved in radial guides) for the work, in that an axially moving ejector is placed around the mandril within the cylindrical sleeve, an inner end (that is to say an end furthest from the work) of the ejector being joined up by way of parts stretching through narrow openings in the mandril, with a turning chucking or chuck driving and ejection rod, which is placed in the central part of the headstock spindle, and in that an axially moving outer chuck ring is present and is oriented around the cylindrical sleeve and the chuck jaws and designed for forcing the chuck jaws radially inwardly by way of driving slopes, the inner end of the chuck ring being joined up with radially extending dogs, which, in each case, are designed extending through a narrow axial opening in the cylindrical sleeve and at a radially inner position slightly overlapping arms of the ejector so that, on moving back of the chuck driving and ejector rod using a first axial driving system, or on moving forwards the chuck ring by way of a second axial driving system, the ejector and the sleeve are moved together in step inwards or outwards, while on moving the chuck driving and ejector rod in the opposite direction, the chuck ring lets the chuck jaws being moved clear of the work.

The middle mandril and the chuck jaws, between which the work is gripped, may, for this reason, be seen to be supported on the headstock spindle so that no change in position of the one in relation to the other is possible. In this respect the chuck jaws are guided axially very exactly so as to remain in the same axial plane on changing their radial position. While the forces acting axially on the chuck jaws are taken up by the headstock spindle by way of the cylindrical sleeve, the chuck jaws are radially supported by the chuck ring which, because of the driving slopes, giving a wedging effect, keeps the jaws in exactly the desired position.

The spinning lathe of the present invention may, generally speaking, furthermore be used for producing other parts in addition to wheel rims. However, producing wheel rims is a preferred use of the invention and, in this case, the inner form of the chuck jaws is made to conform to the outer form or outline of the wheel rim in its snap-in groove part, the chuck jaws extending out axially to the front of the mandril while the outwardly extending part of the outer wall of the snap-in groove is formed in the same way.

BRIEF DESCRIPTION OF THE DRAWINGS

Further developments and useful effects produced by the present invention will be seen from the account now to be given of a working example using the figures.

DETAILED DESCRIPTION

Figure 1:
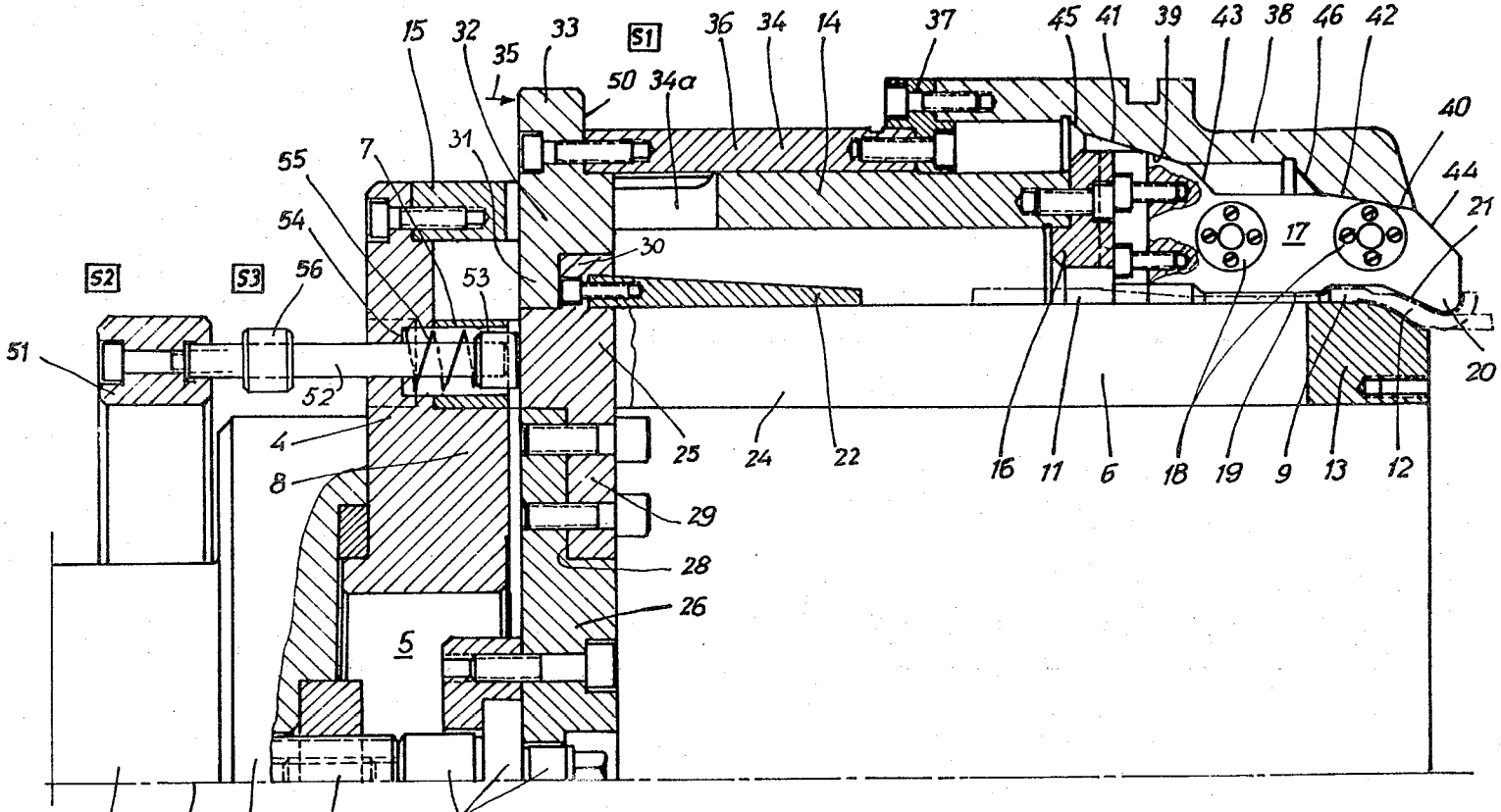
FIG. 1 is a view of the tool part of a spinning lathe with a chucked up wheel rim blank, as seen in an axial section.

In FIG. 1 the tool part of a spinning lathe is shown in axial section, the lathe being radially symmetrical so that only one half thereof is illustrated. Headstock spindle 2, powered for turning about the central axis 1, has a spindle backer plate 3 of greater diameter, on whose one side a tool support face plate 4 is fixed. This face plate 4 may be said to be part of the tool or tool system of the lathe. The tool support face plate 4 has a central opening 5, the face plate extending radially outwardly beyond the backer plate 3. The tool support face plate 4 is fixed to the backer plate 3 in a normal way, of which no details are given here.

On the tool support face plate 4, at its side facing away from backer plate 3, there is a mandril 6 whose ring part 7 is slipped onto a shoulder 8 of the tool support face plate 4, to which it is screwed. The hollow mandril 6 takes the form of a cantilever structure, that is to say its outer end, furthest from the tool support face plate 4, is not itself separately supported and is used for supporting the workpiece 9 to be worked, which is marked in chained lines.

Figure 3:
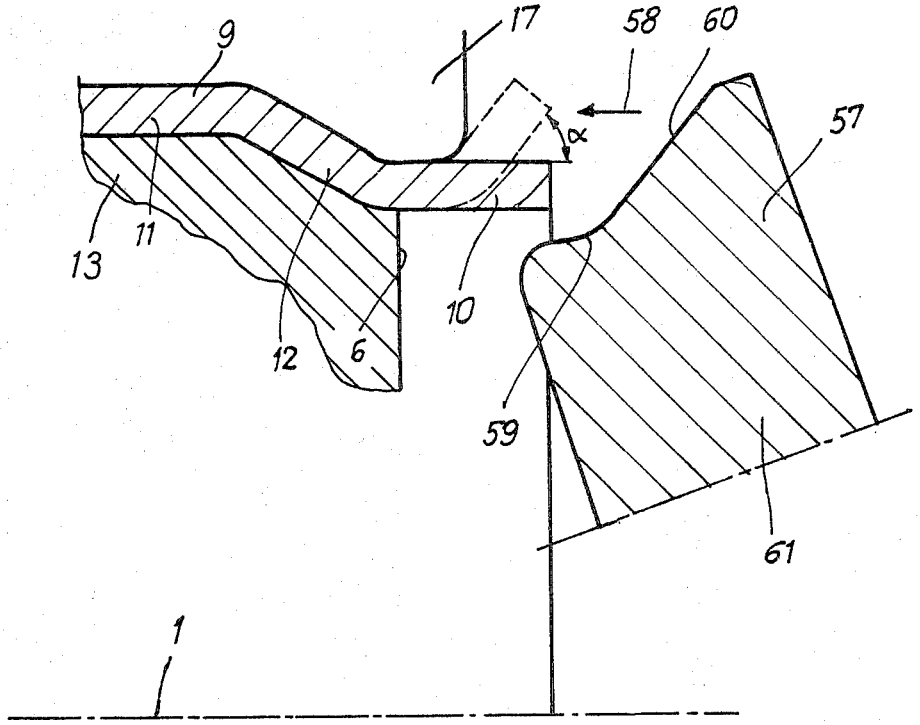
FIG. 3 gives details of the flaring of the edge of the rim blank as far as an inbetween stage of flaring.
Figure 4:
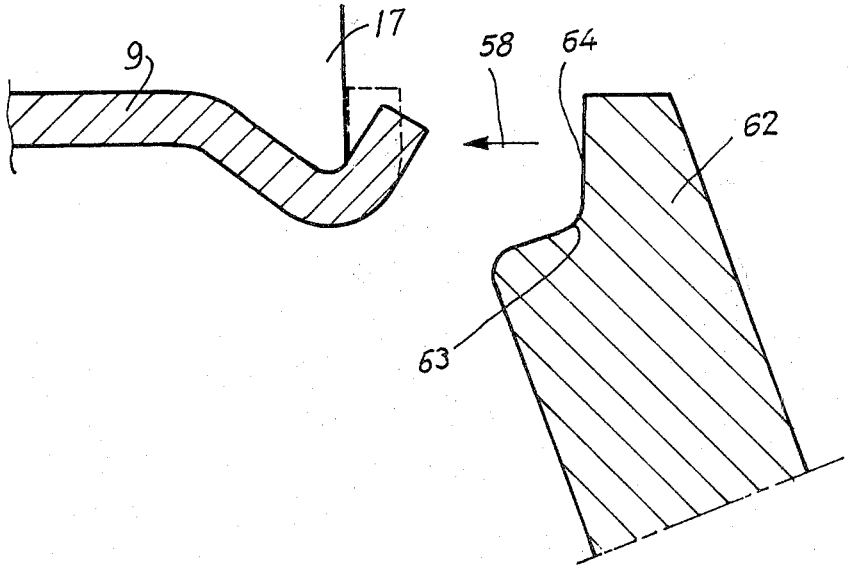
FIG. 4 gives details of the operation for completing the snap-ring groove.
Figure 5:
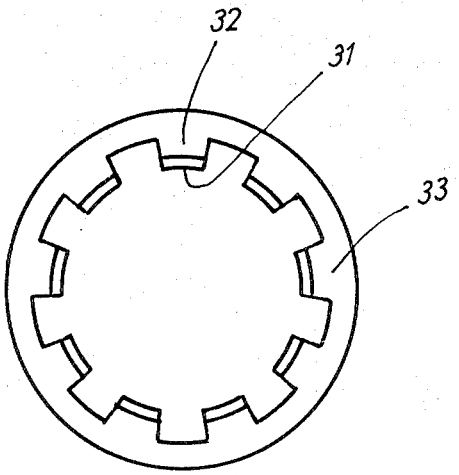
FIG. 5 is an end-on view of the ring plate joined with the chuck ring.
Figure 6:
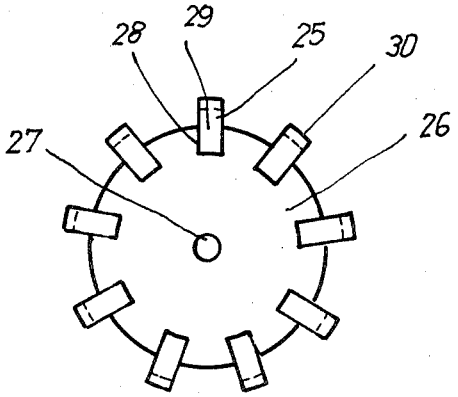
FIG. 6 is a view of the plate body joined with the ejector.

The workpiece 9 is a tubular rim blank for producing the wheel of a road truck, it having a snap-ring groove on one side and a rim flange, next to a sloping shoulder, on the other side. The rim is produced by firstly making a blank from a cylindrical sheet metal casing by expansion and/or upsetting, the blank having between an outer cylindrical part 10 (see FIG. 3) of smaller diameter and an inner cylindrical part 11 of greater diameter a coned part 12. The blank is then tube spun or shear formed in its different parts for producing the desired wall thickness, the blank then having the form marked in chained lines. The tool system to be seen in the figures is, for this reason, designed for further processing of such a blank after a spinning operation in which material flow is produced. The coned part 12 noted takes the form, at the end of processing of the rim, of the inner side of the end snap-ring groove and in the system figured the outer cylindrical part 10 is turned round upwards to take the form of the outer side or wall of the snap-ring groove, as will be made clear later in detail using FIGS. 3 and 4.

The mandril 6, which may be taken to be the spinning form, is cylindrical as far as a point near its free end 13 so as to be the same in size as the inner face of blank 9. Towards its end, mandril 6 is coned in a way answering to the slope of the cone part 12 of the blank so that the blank may be rested axially against the coned end of the mandril. The blank 9 has its outer cylindrical part 10 running out past the end of the mandril 6 (see FIG. 3).

Placed concentrically in relation to the mandril 6 and spaced radially therefrom, there is a cylindrical sleeve 14 fixed to the tool support face plate 4, the end part 15 of sleeve 14 being screwed to face plate 4 so that not only the mandril 6, but furthermore the cylindrical sleeve 14 are joined up not only axially, but furthermore circumferentially with the main spindle or headstock spindel. The cylindrical sleeve 14, placed around the mandril 6, has a ring-like runner 16 at its front (rightward) end, which is used, for its part, for supporting radially moving chuck jaws 17, which are taken up in guideways running radially in the runner 16. A number of such chuck jaws 17 are placed around the central axis 1, the jaws being placed around the mandril with a space therebetween for taking up the blank 9. The central axial section of FIG. 1 is taken along a plane which is between two jaws so that the chuck jaws 17 will be seen in side view and not in section. Between any two chuck jaws 17, there are spring systems 18, taking effect in a circumferential direction, for forcing one chuck jaw and the next one away from each other in the circumferential direction. If there is no outer force having the tendency of pushing the chuck jaws in an inward direction, the jaw chuck formed by the chuck jaws is opened because the chuck jaws 17 are moved radially outwards under the effect of springs 18, and guided by the connection with the ring-like runner 16 and, for this reason, with the cylindrical sleeve 14. The radial guideways used in the present working example take the form of T-like grooves in ring-like runner 16, each such groove taking up the tailpiece (which is T-like in cross-section) of the nearest chuck jaw 17. It would naturally furthermore be possible for the tailpieces to be present on the ring-like runner and for the T-like grooves to be present on the chuck jaws. The inner form 19 of the chuck jaws 17 is, in its inner part, generally the same as the outline of the blank. In the snap-in ring part the inner outline 19 is placed at a slope which is the same as the degree of coning in the part 12 of the rim, the chuck jaws having at their right hand, outer ends, in each case, a nosepiece 20, extending radially inwards and whose form is one answering to the form of the outer face of the snap-in groove part (or snap-ring groove part) of the rim when completed.

Joined up with the outline part 21, which is opposite to the coned part 12 of the blank (this cone part 12 being in the completed rim the inner side of the snap-ring groove), of the chuck jaws it may, for this reason, be seen that there is a part of the face of the chuck jaws which is exactly in agreement with the form of the snap-in groove, the outer ends of the chuck jaws being, in each case, generally normal to the longitudinal axis of the mandril. The chuck jaws 17 are positioned to extend out axially beyond the end of the mandril 6 and the jaws at this position have, as we have noted, a form conforming to the outer side of the snap-in groove (or snap-ring groove) in the completed rim. The chuck jaws 17 may be said to be a female chuck resting against the outer cylindrical part 10 of the blank, the jaws further forming a sort of spinning form.

On the mandril 6, there is an ejector 22, whose inner diameter is the same as the outer diameter of the mandril, the ejector being in the form of a sleeve which is somewhat coned so as to become thinner as it extends to the right in FIG. 1. The ejector may be moved axially. The inner or left end of ejector 22 is joined up with a centrally disposed chucking and ejection rod 23 not only in the direction of turning, but furthermore in the axial direction. The rod 23 is housed inside the headstock spindle 1 and may be moved axially by a driving system as for example a piston and cylinder. Because the ejector 22 is oriented outside the mandril 6, the connection between it and the centrally disposed chucking and ejection rod 23 has to be one extending through the mandril 6 and, for this reason, the mandril 6 has axially extending pockets 24 extending from the front end 13 to the back part 7 of the mandril 6, the mandril having a number of such longitudinally extending pockets 24 evenly spaced round the periphery thereof. Within each pocket 24, there is an arm 25 extending through the same in a radial direction, the outer end of each arm 25 being fixed to the ejector 22 while at its inner end each arm 25 is joined up with the chucking and ejection rod 23. The arms 25 are fixed to an inner wheel or hub structure 26 whose outer diameter is equal to the inner diameter of the mandril 6. The wheel or hub structure 26 is, for its part, joined up by way of a central connection piece 27 with the chucking and ejector rod 23. At the positions of arms 25, wheel structure 26 has radial openings or slots 28 opening at the radially outer part of the wheel structure 26. Within these radial openings 28, there are received bars 29 forming the inner ends of the arms 25. The arms 25 have the same axial length as the wheel structure 26. If the chucking and ejection rod 23 is moved forwards or backwards, the ejector 22 will be moved as well, wheel structure 26 being slipped along the inner face of mandril 6 and the arms 25, extending out radially from the wheel structure 26 and through the longitudinally extending pockets 24 of the mandril, moving the ejector 22. The chucking and ejection rod 23, and the connection piece 27 fixed to it are designed for motion out towards the free end of the mandril 6 from the headstock spindle (or main spindle), the wheel structure 26 extending, together with arms 25 radially outwards in a direction parallel to the tool supporting face plate 4.

At their radially outer or circumferential ends, arms 25 are stepped so that, on the side of each arm nearest the ejector 22, there is an outwardly extending step 30, as shown in axial section. This step 30 is overlapped, on the side thereof facing away from the ejector 22, by a radially inwardly extending part 31 of a dog 32. The number of dogs spaced circumferentially around the structure is the same as the number of arms 25, the arms and the dogs being paired with each other. All dogs 32 are formed by radially inwardly extending ears on a ring-like plate 33, which is in the same plane as the wheel structure 26 and (radially outside the cylindrical sleeve 14) is screwed to a chuck ring 34, which, in the present working example, is made up of a number of separate parts. Cylindrical sleeve 14 has axially extending narrow openings **34*a* (opposite to the pockets 24 of mandril 6), narrow openings 34*a* being shorter than pockets 24 in the mandril 6. Each axially extending narrow opening 34*a* has one of the dogs 32 extending radially through it, the two parts 30, 31 of the arms 25 and of dogs 32 only being loosely placed against each other. The ring-like plate 33 has a second axial driving system working in the direction marked by arrow 35 and which may take the form of a second axial driving system, such as piston and cylinder unit resting against the headstock at its other hand and schematically illustrated in FIG. 1**.

Because the dogs 32 and the arms 25 are only slightly overlapped, on moving back (i.e. to the right) the chucking and ejector rod 23 away from the mandril 6 using the first axial driving system, or on moving forwards (i.e. to the right) the chucking ring 34 in the opposite direction using the second axial driving system, the ejector 22 and the chucking ring 34 are moved, while joined together, inwards or outwards as the case may be. On the other hand, a moving forward (i.e. to the right) of the chucking or ejection rod 23, the chucking ring 34 is no longer joined with the system and is not moved.

The chucking ring 34 is, as has been noted earlier, made in a number of parts, it having a back cylindrical part 36 which is joined up with the ring-like plate 33. The cylindrical part 36 is seated on the cylindrical sleeve 14 and may be moved along it. The outer or right end of the cylindrical part 36 is joined up with a collar 37, to which an outer chuck ring 38 is fixedly oriented around the chuck jaws 17, it resting against their driving slopes 39,40 when the chuck jaws are forced grippingly against the workpiece. In other words, the chuck jaws are forced inwards by way of these driving slopes.

Figure 2:
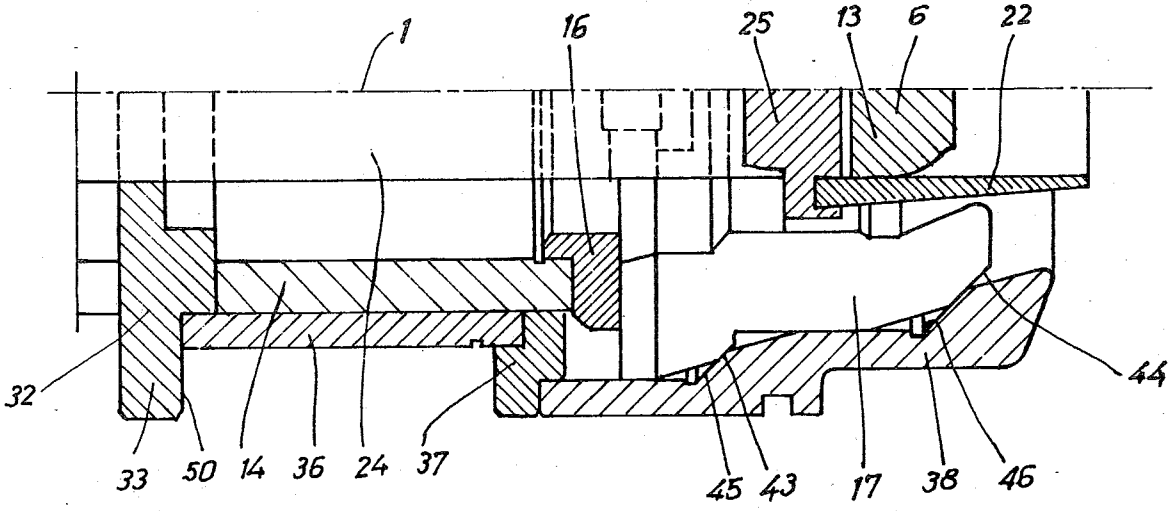
FIG. 2 is a further axial section of part of the spinning lathe of FIG. 1 in a position ready for ejection of the ring blank after the spinning operation.

Such driving slopes 39, 40 and furthermore 41, 42 are present not only on the chuck jaws, but furthermore on the chuck ring 38, such slopes being placed in pairs, the slopes 41, 42 of the outer chuck ring 38 acting against one of the driving slopes 39 or 40 of the chuck jaws 17. Because the driving faces are axially spaced, the parts are specially well-supported and guided without any danger of skewing. The slopes 39 to 42 are placed at a generally small angle to the longitudinal axis of the system. The driving slopes on the outer chuck ring 38 take up the radially outward and the axially forward forces coming from the chuck jaws 17, while the axially inward forces are taken up by the radial guides formed by the cylindrical sleeve 14. Each of the driving slopes is next to a steeper driving slope 43, 44, 45, 46, that is to say the two steeper slopes 43, 44 further outwards on the chuck jaws 17 are next to the driving slopes 39 and 40 while in the case of the outer chuck ring 38, the steeper driving slopes 45 and 46 are to the inside of the slopes with the smaller angle. The purpose of this system of the driving slopes will become clear later in connection with FIG. 2.

OPERATION

An account will now be given of the function of the parts so far noted, while the account of the spinning operation for producing the desired form of the snap-in (or snap-ring) groove using spinning rollers will be kept for later.

In FIG. 1 the chucking and ejection rod 23 will be seen in its chucking position, that is to say in which the work is gripped in the chuck jaws 17 and in which, by way of the wheel structure 26, arms 25 and dogs 32, the chucking ring 34 together with its outer chuck ring 38 are kept by rod 23 in the chucking position, that is to say with the chuck jaws 17 forced against the work. Once the outer cylindrical part 10 (FIG. 3) of the blank has been formed to get the desired form of snap-in groove, the second axial driving system schematically represented by the arrow 35 is used for moving the outer chuck ring 38 forward (or to the right) into the position to be seen in FIG. 2, in which driving slopes 45 and 46 of the outer chuck ring 38 are opposite to driving slopes 43 and 44 of the chuck jaws 17 so that the jaws 17 will move radially outward, under the effect of springs 18, till they come up against these driving slopes, the outcome being that the blank on which the snap-in groove has been produced, is freed and unchucked. At the same time as the chuck ring 34 is moved forwards (i.e. to the right), by way of dogs 32 and arms 25 the ejector 22 is moved along as well. When the outer chuck ring 38 has made its way into the position of FIG. 2, that is to say in which the chuck jaws 17 are moved radially outwards, the ejector 22 will, however, not engage the blank 9 and, for this reason, the chucking and ejector rod 23 is put into operation for moving ejector 22 further forward or to the right till the blank 9 has been ejected thereby. When the ejector 22 is so moved further forward, the dogs 32 and the chuck ring 34 remain in the same position. For putting a new piece of work into the chuck, the ejector 22 is moved back using the chucking and ejection rod 23 into the position noted (whereupon the new blank or work is placed on the mandril 6), that is to say the ejector 22 is in the work take-up position. After putting the blank onto the mandril 6, the chucking and ejector rod 23 is moved further back (i.e. to the left), it moving the chuck ring 34 with it. When this motion takes place, driving slopes 41, 42 of the outer chuck ring 38 are moved up against the driving slopes 39, 40 of the chuck jaws 17, which are moved in their radial guides inwardly onto the blank so that the same is gripped tight ready for spinning of its snap-in groove part.

The front or rightwardly facing end surface 50 of the ring-like plate 33 is designed for acting on a limit switch S1, which is operated when the chuck jaws 17 are in their positions free of engagement with the blank. There are two further limit switches S2 and S3 of which switch S2 is operated after a chucking of the blank so that the main spindle may be put into operation, that is to say turned. Switch S3 is worked in the work take-up position noted earlier.

In connection with operation of the two limit switches S2 and S3, some further design points are to be noted. Headstock spindle (or main spindle) 2 has a switch driving ring 51 placed round it which may be moved over backer plate 3, switch driving ring 51 having equally and circumferentially spaced pins 52 for fixing it to the tool supporting face plate 4, pins 52 extending through the face plate 4 and the end part 7 of mandril 6, the holes for the pins 52 extending through the end part 7 of mandril 6 as far as pockets 24. On the end of each pin 52 nearest to the mandril 6, there is a stop nut 53, screwed on the pin in question, and between this nut and an inner stop face 54 in the tool support face plate 4 there is a coil spring 55 having the effect of pushing the stop nut 53 together with the pin 52 and the switch driving ring 51 towards the mandril 6, the pin 52 having a second stop nut 56 which is on the side of face plate 4 remote from the mandril. Because the first stop nut 53 is, in each case, next to one of the arms 25 and may be freely moved, ring 51 keeps in step with motion of arms 25 and, for this reason, is responsible for operation of the two switches S2 and S3, the one in the chucking position and the other in the work take-up position.

DETAILED ACCOUNT OF SPINNING OPERATION AS PART OF THE PRESENT INVENTION

An account will now be given of the forming by spinning of the outer cylindrical part 10 of the blank 9 for producing the outer wall of the snap-in groove. Once the blank 9 has been chucked and gripped on the mandril 6 using the chuck jaws 17 and the outer chuck ring 38, a first spinning roller 57 (FIG. 3) is moved axially as marked by arrow 58 against the end face of the outer cylindrical part 10. The spinning roller 57 has a part opposite the mandril 6 with a radius 59 equal to the radius of the lower face of the groove, and, furthermore, next to this part, a coned part 60 at an angle to the axis of for example 45° to 75°. Because the spinning or rotating roller 57 is placed so that its axis 61 of turning is at an angle to the axis 1 of the spinning lathe, the value for the angle given here is in respect of the angle which is produced at the position at which the spinning roller takes effect on the blank. When this spinning roller 57 is moved in the direction marked by arrow 58, coned part 60 will be responsible for producing a force in an axial direction and furthermore a flaring force taking effect on the outer cylindrical part 10 of the blank, this effecting at one and the same time an axial upsetting and flaring effect, the flaring being responsible for the inbetween position to be seen in broken lines in FIG. 3 and in full lines in FIG. 4, in which the outer part of the blank is bent outwards at an angle $\alpha$ of for eample 45° to 75°. For this reason, when spinning takes place, there is no decrease in the thickness of the wall. The axis 61 of turning of the spinning roller 57 is, for this reason, at an angle to the axis 1 for stopping any friction between the spinning roller and the blank and limiting the effect to a spinning or rolling motion. In the case of the first spinning roller 57, it is possible, if desired, to do without this position of the axis 61 at an angle.

The second and last stage of forming of the snap-in (or snap-ring) groove is undertaken with a second spinning roller 62 (FIG. 4) whose axis of turning is, as well, at an angle to the axis 1 and this roller 62 is again moved forwards in an axial direction up to the work. This second spinning roller 62 again has a radius 63 answering to the form of the lower face of the snap-in groove in the work when completed, this radius being next to a generally radial part 64, which takes effect on the outer wall of the snap-in groove when completed. The second spinning roller 62 may, for this reason, be seen to have the effect of pushing the outer part of the blank out of its position of FIG. 3 into that to be seen in FIG. 4 in broken lines. By moving the roller further, a further upsetting effect at the lower wall of the snap-in groove may be produced.

The spinning operation takes place against the chuck jaws 17 which, as we have seen, have a form conforming to that of the snap-in groove so that these chuck jaws make up a part of the spinning form. Because the jaws are exactly, and with a strong supporting effect, kept in position axially and radially, the spinning operation is responsible for producing a very true form of the work.

The two spinning rollers 57 and 62 may be supported on a single support system in which they are angularly spaced by 180° about the axis 1 of the spinning lathe, the second spinning roller only being moved up against the work when the first spinning roller has completed its own operation.

After producing the snap-in groove in the way noted, the rim side flange is bent up, something which is of no interest in the present connection.

The embodiments of the invention in which an exclusive property or privilege is claimed are defined as follows:

1. A process for making a wheel rim having a snap-in groove on one side, wherein there is provided a tubular blank having ends of different diameters and, located therebetween, a coned part for forming an eventual inner wall of the snap-in groove, an outer cylindrical part is provided at the smaller diameter end of the coned part, the blank is slipped onto a mandril, which is coned at one end thereof with the same cone form as the coned part of the rim blank, the cylindrical part of said blank being kept clear of said mandril and extending beyond said one end thereof, the blank is then gripped by means of an outer chuck, and then at least one spinning roller having an outline corresponding to the desired form of the rim is moved axially against the smaller diameter end of the said blank whereby the outer cylindrical end part is upset and bent outwards against the outer chuck, by which it is supported, for producing the outer wall of the snap-in groove.

2. A process according to claim 1, wherein a first spinning roller is used for outwardly bending said outer cylindrical part, whereafter the outer wall form of the snap-in groove is completed by using a second spinning roller, the first spinning roller being responsible for axially upsetting and at the same time outwardly flaring the blank, whereas a second spinning roller is used for firstly only bending the now outwardly flared part and then upsetting the latter till the blank has the desired wall thickness for the snap-in groove, at least the second spinning roller being moved against the blank axially and having a spinning axis extending at an angle to the spinning axis of the mandril.

3. A process according to claim 2, wherein the outer cylindrical part of said blank is bent outwards by said first spinning roller to have an angle of 45°-75° to the spinning axis of the mandril.

4. A process as claimed in claim 2 or 3, wherein the two spinning rollers are used one after the other and are supported in a common support.

5. A spinning lathe for producing a wheel rim having a snap-in groove on one side, from a tubular blank having ends of different diameters and, located therebetweeen, a coned part for forming an eventual inner wall of the snap-in groove with an outer cylindrical part being provided at the smaller diameter end of the coned part, the lathe comprising a headstock spindle, a mandril fixed at a back end thereof to said headstock spindle, a cylindrical sleeve placed around said mandril concentrically and radially spaced therefrom, said sleeve being fixed at a back end thereof to said headstock spindle, the other, front end of said sleeve having a radial guide system, chuck jaws radially guided by way of said guide system of said sleeve, an ejector axially movable on said mandril, said ejector being located between said mandrel and said sleeve, a chuck driving an ejector rod placed centrally within said headstock spindle, said rod being designed to be rotatable with said spindle, radial arms connecting said ejector with said rod, said arms being positioned in openings in said mandril, and axially movable outer chuck ring placed around said jaws and said sleeve, said chuck ring having, at a front end thereof, slopes for slipping over and forcing inwards, slopes on said chuck jaws, said chuck ring having, at a back end thereof, radially inwardly extending dogs, each positioned in an axially extending opening in said sleeve and slightly overlapping arms forming part of said ejector, a first axial driving system for driving said ejector rod away from the front end of said mandril, a second axial driving system for moving said chuck ring towards the front end of said mandril, motion of said rod away from said mandril front end using said first driving system causing said ejector and said chuck ring to be moved together while coupled together, said second driving system being designed for moving said ejector and said chuck ring towards the front end of said mandril, while on motion of said rod towards the front end of said mandril the chuck ring is uncoupled from said rod.

6. A spinning lathe according to claim 5, wherein the jaws have an outline corresponding to the outer form of the wheel rim to be produced.

7. A spinning lathe according to claim 6, wherein the jaws have end parts extending beyond the front end of the mandril, the jaw end parts having outlines corresponding to an outer side wall of the snap-in groove to be produced.

8. A spinning lathe according to claim 5, claim 6 or claim 7, wherein the jaws each have two axially spaced slopes for co-operating with two axially spaced slopes in said chuck ring.

9. A spinning lathe according to claim 6, wherein the jaws each have two axially spaced slopes for use with two axially spaced slopes in said chuck ring, each said slope being axially adjacent to a slope which is steeper in relation to the axis of spinning.

10. A spinning lathe according to claim 5, claim 6 or claim 7, wherein springs are provided between said jaws for producing circumferential forces.

11. A spinning lathe according to claim 5, claim 6 or claim 7, wherein said guide system for said jaws takes the form of T-like openings in said sleeve for locating T-like parts of said jaws.

12. A spinning lathe according to claim 5, claim 6 or claim 7, wherein an inner wheel structure is provided having said arms of said ejector fixed thereto, said wheel structure having an outer diameter equal to the inner diameter of an axial bore through said mandril.

13. A spinning lathe according to claim 12, wherein said arms take the form of bars fixed in radial openings in said wheel structure.

14. A spinning lathe according to claim 5, claim 6 or claim 7, wherein the dogs are formed on a chucking plate connected with said chuck ring.

15. A spinning lathe according to claim 14, wherein the dogs and the arms are steppingly overlapped.

16. A spinning lathe according to claim 15, wherein the openings in said mandril are axially longer than those in said sleeve.

17. A spinning lathe according to claim 16, wherein a tool supporting face plate is provided on which the sleeve and the mandril are supported.

18. A spinning lathe according to claim 5, claim 6 or claim 7, wherein at least one spinning roller is provided to be movable towards a space between the mandril and the jaws, said space being adapted to receive said rim blank, said roller furthermore being movable axially for flaring the outer cylindrical part of said blank by means of a part of said roller having a radius corresponding to the curved form of the base of the groove, an adjacent part of said roller being coned or radial.

19. A spinning lathe according to claim 18, wherein at least two spinning rollers are provided, of which one has its spinning axis extending at an angle to the spinning axis of the lathe.

* * * * *